US009657434B2

(12) United States Patent
Garrone et al.

(10) Patent No.: US 9,657,434 B2
(45) Date of Patent: May 23, 2017

(54) MACHINE FOR SPREADING OUT AND LOADING FLAT CLOTHING ARTICLES WITH AN AUXILIARY DEVICE THAT DEPOSITS AND FEEDS FLAT CLOTHING ARTICLES ON A CONVEYOR BELT

(71) Applicant: GIRBAU ROBOTICS, Gresy sur Aix (FR)

(72) Inventors: Dominique Garrone, Gresy sur Aix (FR); Sylvain Duplouy, Gresy sur Aix (FR); Manuel Gorriz, Gresy sur Aix (FR)

(73) Assignee: GIRBAU ROBOTICS, Grésy-sur-Aix (FR)

( * ) Notice: Subject to any disclaimer, the term of this patent is extended or adjusted under 35 U.S.C. 154(b) by 54 days.

(21) Appl. No.: 14/808,136

(22) Filed: Jul. 24, 2015

(65) Prior Publication Data

US 2016/0024706 A1 Jan. 28, 2016

(30) Foreign Application Priority Data

Jul. 24, 2014 (EP) ..... 14002548

(51) Int. Cl.

| | |
|---|---|
| ***D06F 67/04*** | (2006.01) |
| ***D06F 67/10*** | (2006.01) |
| *D06F 45/28* | (2006.01) |

(52) U.S. Cl.

CPC ..... *D06F 67/04* (2013.01); *D06F 67/10* (2013.01); *D06F 45/28* (2013.01)

(58) Field of Classification Search

CPC ..... D06F 67/00; D06F 67/04; D06F 67/06; D06F 67/08; D06F 67/10; D06F 69/02; D06F 71/00; D06F 45/28

See application file for complete search history.

(56) References Cited

U.S. PATENT DOCUMENTS 3,136,081 A * 6/1964 Fredholm ..... D06C 3/00 226/92
3,421,756 A * 1/1969 Weir ..... D06F 67/04 271/277

(Continued)

FOREIGN PATENT DOCUMENTS

EP A1-2584087 3/2015
WO WO2009118644 A2 * 10/2009

*Primary Examiner* — Ismael Izaguirre
(74) *Attorney, Agent, or Firm* — Robert J. Hess; Hess Patent Law Firm

(57) ABSTRACT

A machine that spreads out and loads flat clothing articles with an auxiliary device that deposits and feeds the flat clothing articles on a conveyer belt. The auxiliary device is located above loading end (30*a*) of a conveyor belt (30), extending transverse to a loading direction (D) and comprises a roof plate (13) pivotally articulated around an axis (14) transverse to loading direction (D) and providing a first position (RP1) in which the roof plate (13) is separated from the conveyor belt (30) providing a wide opening for reception of an edge of a flat clothing article (A) and a second position (RP2) in which a roof plate front end (13*a*) lies close to the loading end (30*a*) of the conveyor belt (30) allowing a controlled passage of the flat clothing article (A) on said conveyor belt (30), and driving means producing a rotation of said roof plate (13) between said first (RP1) and second (RP2) position in coordination with the operation of deposition means including nozzles (12, 15).

18 Claims, 8 Drawing Sheets

(56) References Cited

U.S. PATENT DOCUMENTS

| | | | | | |
|---|---|---|---|---|---|
| 3,552,743 | A * | 1/1971 | Baboz | D06F 67/04 | 271/265.01 |
| 4,729,181 | A | 3/1988 | Weir | | |
| 4,967,495 | A * | 11/1990 | Weir | D06F 67/04 | 38/143 |
| 5,172,502 | A | 12/1992 | Kober | | |
| 5,815,963 | A * | 10/1998 | Rauch | D06F 67/04 | 38/143 |
| 2010/0024260 | A1 * | 2/2010 | Nielsen | D06F 67/04 | 38/143 |

* cited by examiner

MACHINE FOR SPREADING OUT AND LOADING FLAT CLOTHING ARTICLES WITH AN AUXILIARY DEVICE THAT DEPOSITS AND FEEDS FLAT CLOTHING ARTICLES ON A CONVEYOR BELT

TECHNICAL FIELD

The present invention relates to equipment for feeding laundry articles onto a conveyor system from which they are fed into subsequent processing machinery such as ironing machines, dryer, folding machines or the like.

The auxiliary device of this invention is intended to be installed in a machine for spreading out and loading flat clothing articles to a laundry processing unit, the machine including two or more loading stations served by respective operators for spreading and loading large flat clothing articles, such as sheets or tablecloths, in a semiautomatic loading mode, and alternatively allows spreading and loading small flat clothing articles, such as napkins, pillowcases, cloths or tablecloths in a manual loading mode.

BACKGROUND OF THE INVENTION

U.S. Pat. No. 472,918 discloses a laundry feeding machine including a conveyor moving through a suction induction tunnel. Articles are held at their upper edges by an automatically releasing clamp to hang in front of the induction tunnel. Upon release of the clamp, a valving system is immediately actuated to apply suction to suck the article in to lie flat on the conveyor to be transported thereby. FIGS. 10 and 11 show an embodiment particularly adapted to the handling of very wide articles such as bed sheets including a transverse suction chamber that is evacuated by a blower at either end. The conveyor belts pass immediately over the top of the suction chamber. A nip roller 92 is positioned close to the end of the tunnel 94 to provide an adequate air seal to insure that the flow of air from the tunnel inlet 96 is confined to flow into the suction chamber.

U.S. Pat. No. 5,172,502 describes a feeding aid for assisting in the feeding of laundry flatwork to laundry processing equipment such as an ironer.

EP-A1-2584087 discloses a machine for spreading out and loading flat clothing articles onto a conveyor belt 30. The machine comprises a separator element 9 in the shape of a plate located above the conveyor belt 30 and the suction chamber. This separator element is moved by driving means in coordination with the movements of a protective cover 11 (associated to spreading clamps) between a separating position (FIG. 9) corresponding with the free passage position of the protective cover 11, and a refracted position (FIG. 10) corresponding with the retaining position of the protective cover 11. In the mentioned separating position (FIG. 9), a separating edge 9a of said separator element 9 is at a distance from the protective cover 11, which is located in its free passage position. This distance is sufficient to allow the passage of a first, second and third flat clothing articles A1, A2, A3 (A1 in FIG. 9) held and moved by the first or second spreading clamps 4*a*, 4*b*; 5*a*, 5*b* between their receiving and spread out positions but insufficient to allow the access of the hands of an operator to dangerous areas of the machine where the spreading clamps move at high speed.

However the embodiments of the prior art still are deficient in the transfer of the flat clothing articles as linen from the spreading clamps when being blow pushed onto the conveyor, mainly at the loading end or entrance of the conveyor and in the transition area. The following problems have been detected:

- loads due to undulation parts of the flat clothing while released by the clamps should be relieved
- the fall of the article should be better mastered;
- efficiently flat positioning of the article on the conveyor loading end is needed;
- a suitable cutch up of the corners is required;
- avoid interference between the pieces of clothing transferred and the newly arrived;
- reduce the friction of the clothing.

The present invention addresses all these problems and provides a suitable solution thereof.

DISCLOSURE OF THE INVENTION

For this purpose an auxiliary device for deposition and feeding of flat clothing articles on a conveyor belt in a machine for spreading out and loading flat clothing articles, such linen, is provided.

The cited machines such the one disclosed in cited EP-A1-2584087 comprises according to a know structure, following basic parts:

- a frame supporting one conveyor belt that moves in a loading direction (D);
- a protective cover facing a loading end or entrance of this conveyor belt that is equipped with suction means in an area close to this entrance;
- two or more loading stations each including a pair of spreading clamps moved by driving means along a guide rail transverse to said loading direction (D) between a receiving position, in which said spreading clamps are adjacent to one another in one of said loading stations for catching respective contiguous corners of a flat clothing article (A) manually loaded by an operator, and a spread out position, in which the spreading clamps are separated from one another holding said flat clothing article (A) by one its edges spread out and facing said loading end of the conveyor belt; and
- deposition means for depositing, upon clamps aperture, an upper end of said flat clothing article on the conveyor belt from said spread out position of the spreading clamps, with the assistance of blowing nozzles acting against a surface of the clothing article (A) pushing it towards the conveyor belt.

The auxiliary device of this invention is located in superposition to the conveyor belt loading end, extending transverse to said loading direction (D) and comprises:

- a roof plate pivotally articulated around an axis transverse to said loading direction (D) and that provides:
  - a first position (RP1) in which the roof plate is separated from the conveyor belt defining a wide opening for reception of a front edge of said flat clothing article that has previously been spread out and
  - a second position (RP2) in which a roof plate front end lies close to the loading end of the conveyor belt allowing a controlled passage of the flat clothing article (A) extended on said conveyor belt, and covers the suction area of the conveyor surface avoiding that another flat clothing article A being spread by the spreading clamps be affected by said suction or the loading end of the conveyor belt;

driving means producing a rotation of said roof plate between said first (RP1) and second (RP2) position in coordination with the operation of said deposition means.

In this manner when the front edge of the flat clothing article is pushed toward the conveyor belt loading end a wide opening effectively receives said portion of the flat article offering no impediment to the entrance. Besides roof plate front end has a rounded profile providing a support that assists in the conveyance of the flat clothing article (A) towards the inside of referred wide opening provided by the roof plate while in said first position (RP1)

Moreover the auxiliary device further includes additional blowing nozzles attached to the underside of said roof plate in an area close to its front end and oriented against said conveyor belt in the loading direction (D). In this manner the transfer of the article toward the surface of the conveyor belt is assisted and a better platting of the cloth article is assured.

The device also provides a spoil articulated around an axis transverse to said loading direction (D) and defining a first position (SP1) in which a front end is separated from the conveyor belt and a second position (SP2) in which said spoil front end lies on the surface (or at a close distance) of a flat clothing article (A) deposited on and transferred by said conveyor belt flattening said clothing article (A). Driving means produce a rotation of said spoil between first (SP1) and second position (SP2) in coordination with the movements of said the roof plate so that when the spoil is in said first spoil position (SP1) roof plate is in said second position (RP2) and second spoil position (SP2) corresponds to said first roof plate position (RP1).

In this way a channel with progressive narrowing is provided by the roof plate in the first position (RP1) and the spoil in said second position (SP2) closes said channel at a rear part thereof leaving a tight passage for the flattened clothing article (A).

According to an embodiment said spoil is attached to an end of said roof plate remote from said front end and the roof plate and spoil are driven by same driving means or in the alternative the spoil is driven by an own driving means.

Described roof plate is arranged on guides extending in the loading direction (D) allowing to take a third roof plate position (RP3) by sliding along said guides in which the auxiliary device is withdrawn from its location in superposition to said loading end of the conveyor belt and allowing then a manual loading of clothing articles onto the conveyor belt.

The cited third roof plate position (RP3) can be obtained by automatic driving means such as by a pneumatic cylinder or manually operated.

To reduce separate the pieces of cloth transferred toward the conveyor belt from new cloths pieces arriving and relieve the loads due to undulation part of the flat clothing deposition means further include a rotatable roll on which a part of the flat clothing material (A) lies before being transferred towards the conveyor belt, said rotatable roll being placed facing said conveyor belt loading end and at a distance thereof In turn the roof plate of the auxiliary device includes a cover movable in extension (actuated by a driving means) to a fourth position (RP4) in which said roof plate front end lies over said rotatable roll providing a support for the flat clothing article (A) while a previous flat clothing article (A) is transported through said loading end of the conveyor belt.

BRIEF DESCRIPTION OF THE DRAWINGS

The foregoing and other features and advantages will be better understood from the following detailed description of exemplary embodiments with reference to the attached drawings, in which.

DETAILED DESCRIPTION OF EXEMPLARY EMBODIMENTS

Figure 1A:
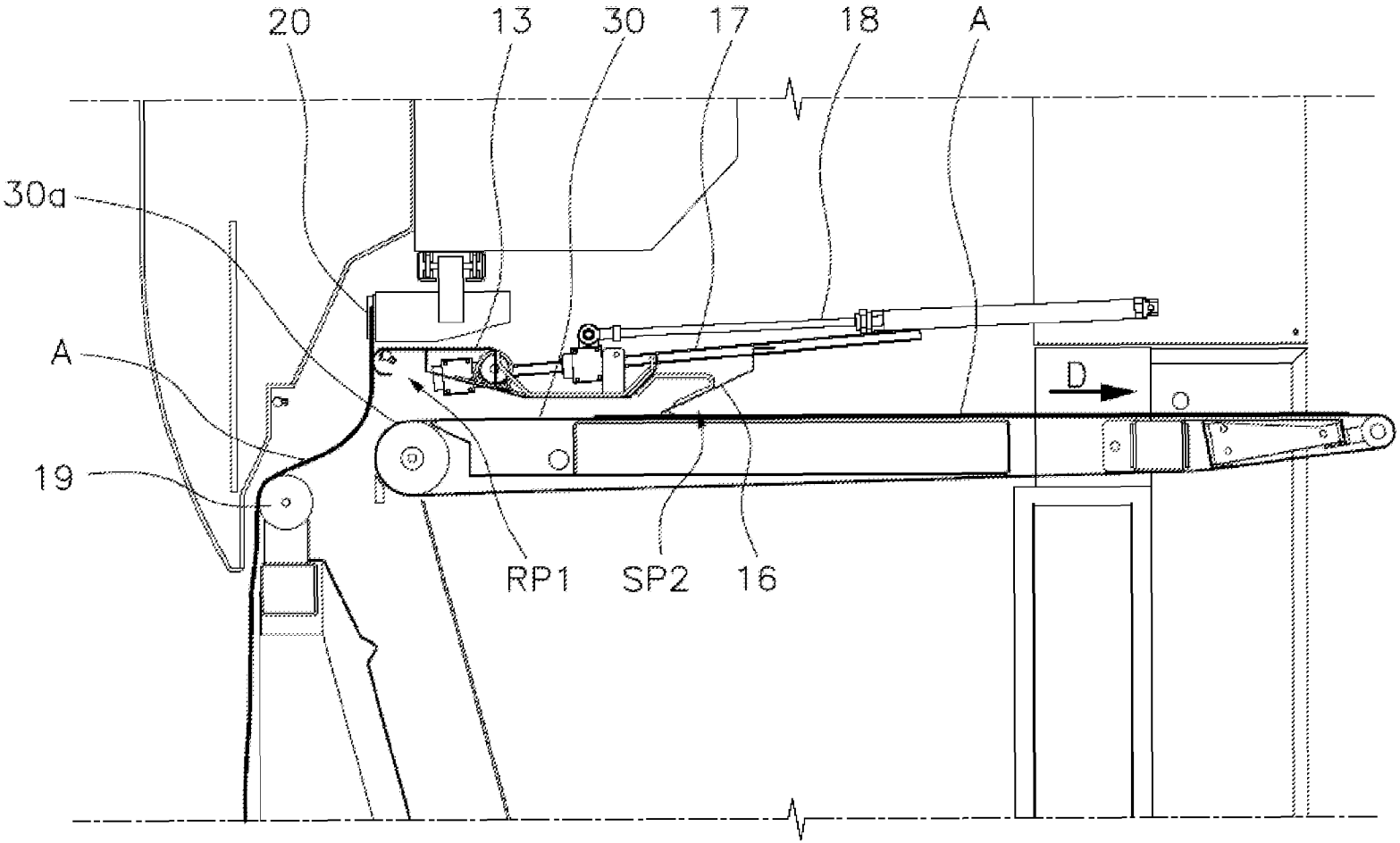
FIG. 1*a* is a schematic plan view of an auxiliary device for a machine for spreading out and loading flat clothing articles according to a first embodiment of the present invention with two or more loading stations in a semiautomatic loading mode, with roof plate in a first position, spoil in a second position, and with a flat clothing article being gripped by clamps in front of the conveyor belt loading end, and another flat clothing article being conveyed on the conveyor belt, being said machine equipped with a rotating roll.
Figure 1B:
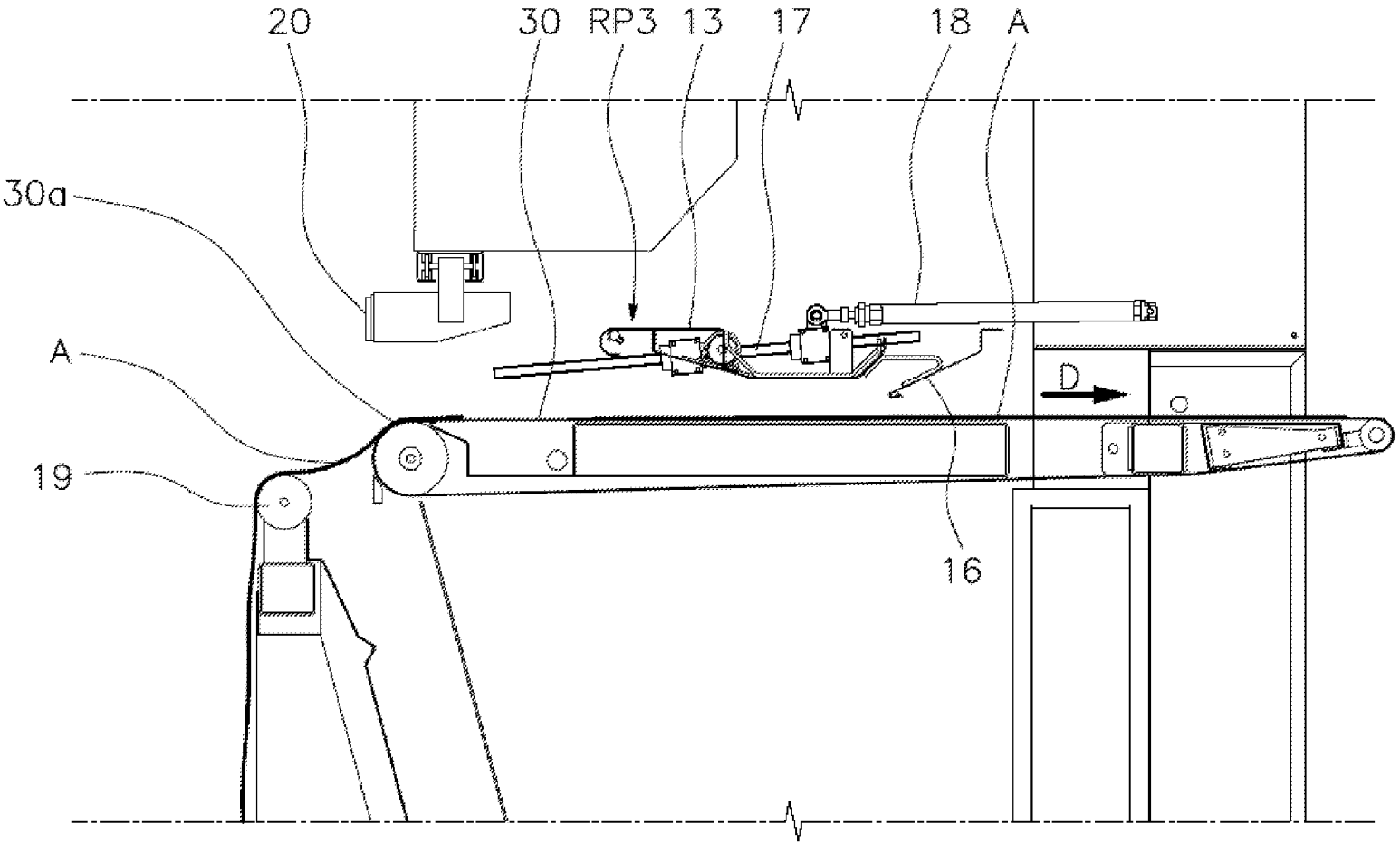
FIG. 1*b* is equivalent to the previous one but the auxiliary device withdrawn into a third position allowing manual loading article onto the conveyor.

FIGS. 1*a* to 6 show an auxiliary device for a machine for spreading out and loading flat clothing articles according to this invention.

The machine comprises a conveyor belt 30 having a considerably horizontal or slightly inclined upper section moving in a loading direction D, and several pairs of clamps 20 installed on corresponding carriages which are independently moved by driving means along a guide rail, transverse to said loading direction D, between a receiving position, in which said first spreading clamps 20 are adjacent to one another in a loading station, and in which it receives contiguous corners of flat clothing articles A loaded manually by operators, and a spread out position, in which the spreading clamps 20 are separated from one another and positioned facing the loading end of the conveyor belt 30, spreading the flat clothing article A.

The auxiliary device of this invention helps in the transfer of said flat clothing article A from said position facing the loading end, and held by the spreading clamps 20, to an extended position with upper part of the flat clothing article A placed on the conveyor belt loading end 30*a*.

According to a preferred embodiment illustrated on FIG. 1*a* to 7, the auxiliary device comprises a roof plate 13 located over the loading end 30*a*, and extended and articulated around a pivot axis 14 transverse to the loading direction D. Said pivot axis 14 allows said roof plate 13 to tilt between a first position (FIGS. 1*a*, 2 and 3), in which the roof plate 13 and its front end 13*a* are separated from the conveyor belt 30 leading end 30*a*, defining a wide opening for reception of the flat clothing articles A, and a second position (FIGS. 4, 5, 6 and 7), in which the roof plate 13 and its front end 13*a* are close to the conveyor belt 30 loading end 30*a*, allowing a passage of the flat clothing article A extended on said conveyor belt 30.

The roof plate 13 includes a spoil 16 attached at a rear part of it, being said spoil 16 able to tilt around the pivot axis 14 between a first position (FIGS. 4, 5, 6 and 7), in which the spoil 16 and its front end 16*a* are separated from the conveyor belt 30, defining a wide opening, and a second position (FIGS. 1*a*, 2 and 3), in which the spoil 16 and its front end 16*a* are close to the conveyor belt 30, allowing a passage of the flat clothing article A on said conveyor belt 30.

The roof plate 13 and the spoil 16 tilt around the pivot axis 14 at the same time because its attachment, and are configured to be on opposite positions, so when the roof plate 13 is on the first position, the spoil 16 is on the second position, and vice versa.

The pivot axis 14 rotation is activated by driving means, as for example: an electric motor, a hydraulic piston, a servomotor, a lineal motor, an electromagnetic pusher, etc.

The roof plate 13, the pivot axis 14, the driving means, and the spoil 16 are linked to guides 17, along which all of them can slide. Said guides 17 are not parallel regarding the conveyor belt 30 upper said, so sliding said devices on said guides 17, the distance between the pivot axis 14 and the conveyor belt 30 is increased, and the auxiliary device is disabled allowing for a manual loading operation mode (shown on FIG. 1*b*). This retired position of the roof plate 13 is the thereafter called third position.

The sliding movement along said guides 17 is achieved, on the preferred embodiment illustrated on FIG. 1*a* to FIG. 7, by a driving means 18 illustrated as a piston, but any other driving mean is contemplated, as a lineal motor, a threaded shaft, or any other well known in the state of art. The manual operation of said sliding movement is also contemplated.

In the illustrated example on FIG. 1*a* to 6, deposition means include blowing nozzles 12 fixed to the protective cover 11 and arranged to blow an airflow on an upper part of the flat clothing article A comprised between the loading end 30*a* and the pair of spreading clamps 20, An additional blowing nozzle 15 is attached to the roof plate 13 placed on the lower side thereof, in an area close to the front end 13*a*, and directed against the conveyor belt 30 in the loading direction D, so that the airflow blown by said additional blowing nozzle 15, produces a further extension of the flat clothing article A loading edge, preventing undesirable folds of the flat clothing article A while in the transition movement to be placed against the conveyor end 30*a*.

In order to prevent the fall of the flat clothing article A, after the release of the spreading clamps 20, and before its extension on the conveyor belt 30, two different embodiments are illustrated. On FIG. 1*a* to 6, a first embodiment is illustrated, in which a rotating roll 19 is placed confronted to the conveyor belt 30 front end 30*a*, existing a wide gap between them. When the flat clothing article A is gripped on the spreading clamps 20, said flat clothing article A is partially supported on said rotating roll 19, lying on it. By the rotation of the rotating roll 19, the flat clothing article A pending portion is partially lifted and introduced on said wide gap, so the majority of the flat clothing article A weight is supported on the rotating roll 19, and the loading end 30*a* only supports the weight of the flat clothing article A portion introduced on said wide gap.

On FIGS. 2 to 7 a suction box 21 placed under the loading end 30*a* of the conveyor belt 30 is detailed, so that the flat clothing article A gripped by the spreading clamps 20 is pending in front of said suction box 21, and the suction produced supports partially the weight of the pending flat clothing article A. The same suction box 21 also helps the rotating roll 19 to introduce the flat clothing article A inside the wide gap.

Thereafter the flat clothing article A transfer process from the spreading clamps 20 to the conveyor belt 30, using the auxiliary device is described.

Figure 2:
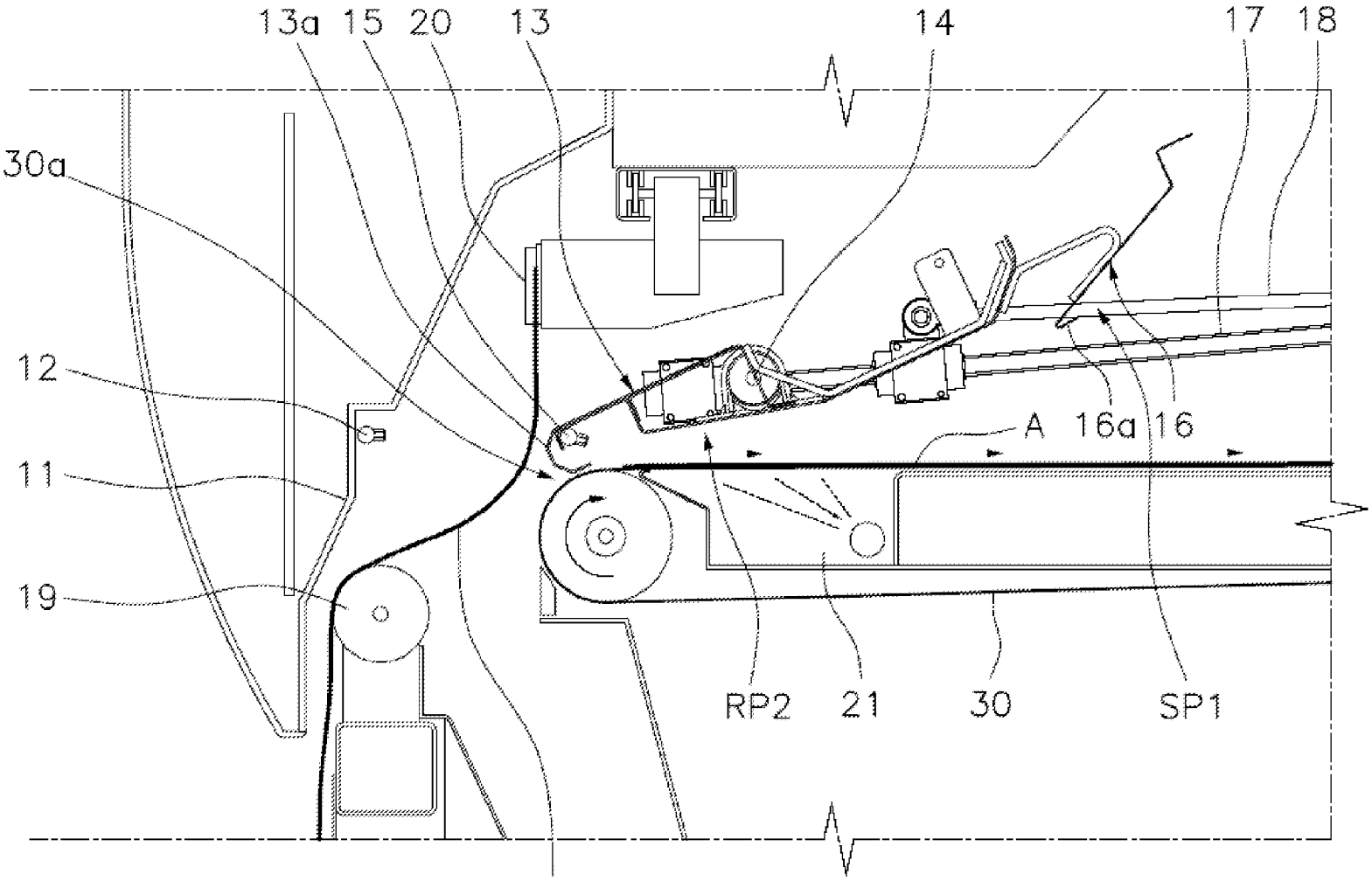
FIG. 2 is a detail schematic plan view of the auxiliary device of FIG. 1*a* in the semiautomatic loading mode in a first operation step, wherein the roof plate is in a second position RP2, the spoil is in a first position SP1, the flat clothing article being conveyed by the conveyor belt, and another flat clothing article being gripped by the clamps and spread out.

In a first step illustrated on FIG. 2, the spreading clamps 20 have spread out a flat clothing article A in front of the loading end 30*a*, being the roof plate 13 on the second position RP2, and being the spoil in the first position SP1.

Figure 3:
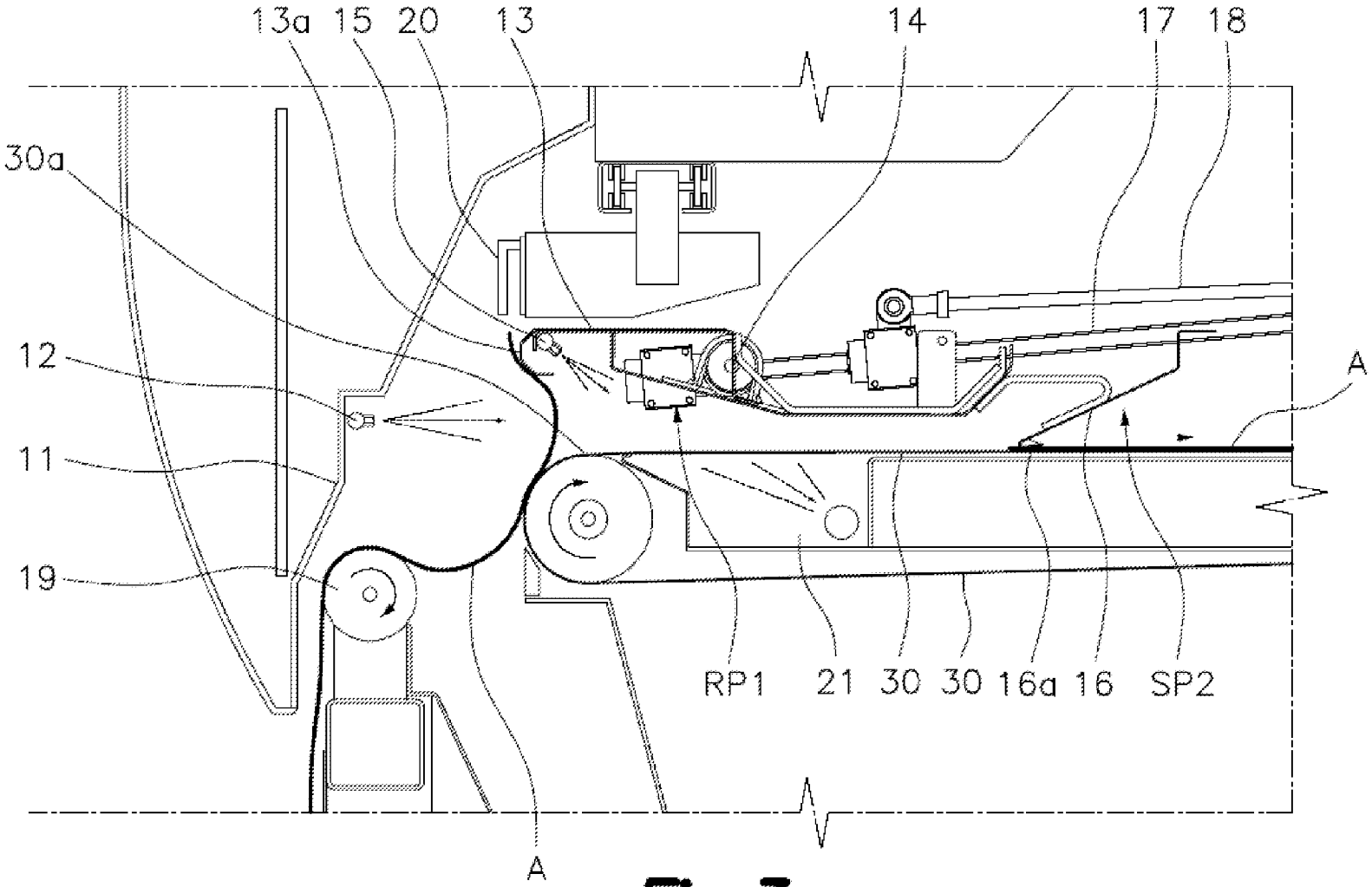
FIG. 3 is a detail schematic plan view of the auxiliary device of FIG. 1*a*, in the semiautomatic loading mode in a second operation step, wherein the roof plate is in a first position RP1, the spoil is in a second position SP2, and the blow nozzles are activated, and a flat clothing article, as linen, is unleashed by clamps in front of the conveyor belt loading end.

In a second step illustrated on FIG. 3, the spreading clamps 20 release the flat clothing article A corners, and the airflow produced by the blow nozzle 12 and the additional blow nozzle 15 attached to roof plate 13 introduces and extends a portion of said flat clothing article A on the conveyor belt 30 loading end 30*a*.

The rotating roll 19 introduces a portion of the flat clothing article A inside the wide gap, and the blow nozzle 12 produces an airflow which pushes the flat clothing article A upper segment against the loading end 30*a*.

Figure 4:
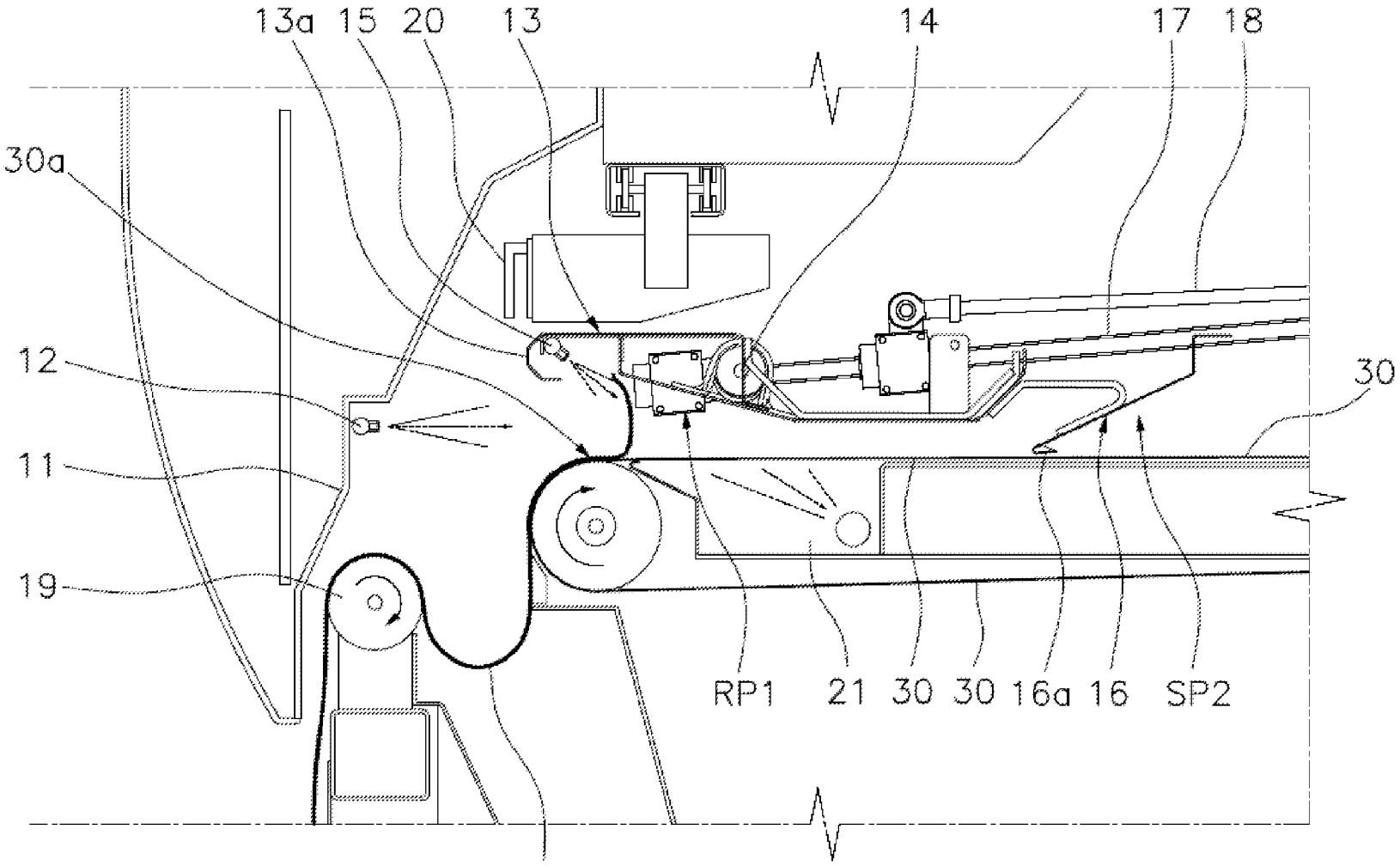
FIG. 4 is a detail schematic plan view of the auxiliary device of FIG. 1*a* in the semiautomatic loading mode in a third operation step, wherein the roof plate is in a first position RP1, the spoil is in a second position SP2, the blow nozzles are activated, and the flat clothing article A released from said clamps, being a portion of the flat clothing article extended on the conveyor belt loading end by the airflow.

FIG. 4 is a third step showing the transition of the flat clothing article A towards the conveyor belt loading end 30*a* pushed by both nozzles 12 and 15.

Figure 5:
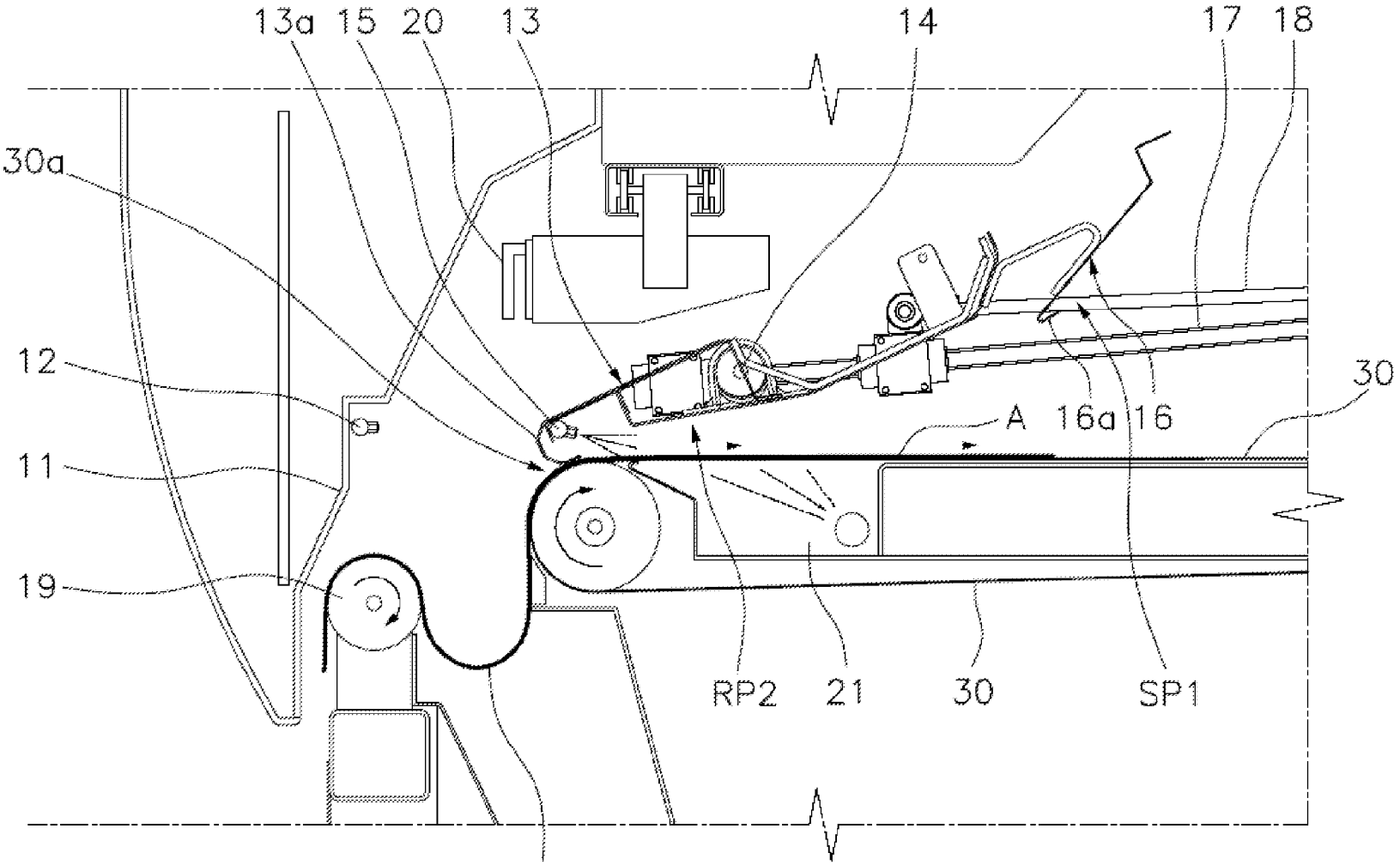
FIG. 5 is a detail schematic plan view of the auxiliary device of FIG. 1*a* in the semiautomatic loading mode in a fourth operation step, wherein the roof plate is in a second position RP2, the spoil is in a first position SP1, and the flat clothing article A being conveyed and loaded on the conveyor belt.

In FIG. 5, the fourth step is illustrated, in which the roof plate 13 is rotated towards RP1 position regarding the pivot axis 14, by said driving means, and the front end 13*a* of said roof plate 13 is placed slightly above the conveyor belt 30, so that the additional blow nozzle 15 blows close to the flat clothing article A, ensuring its proper extension.

Figure 6:
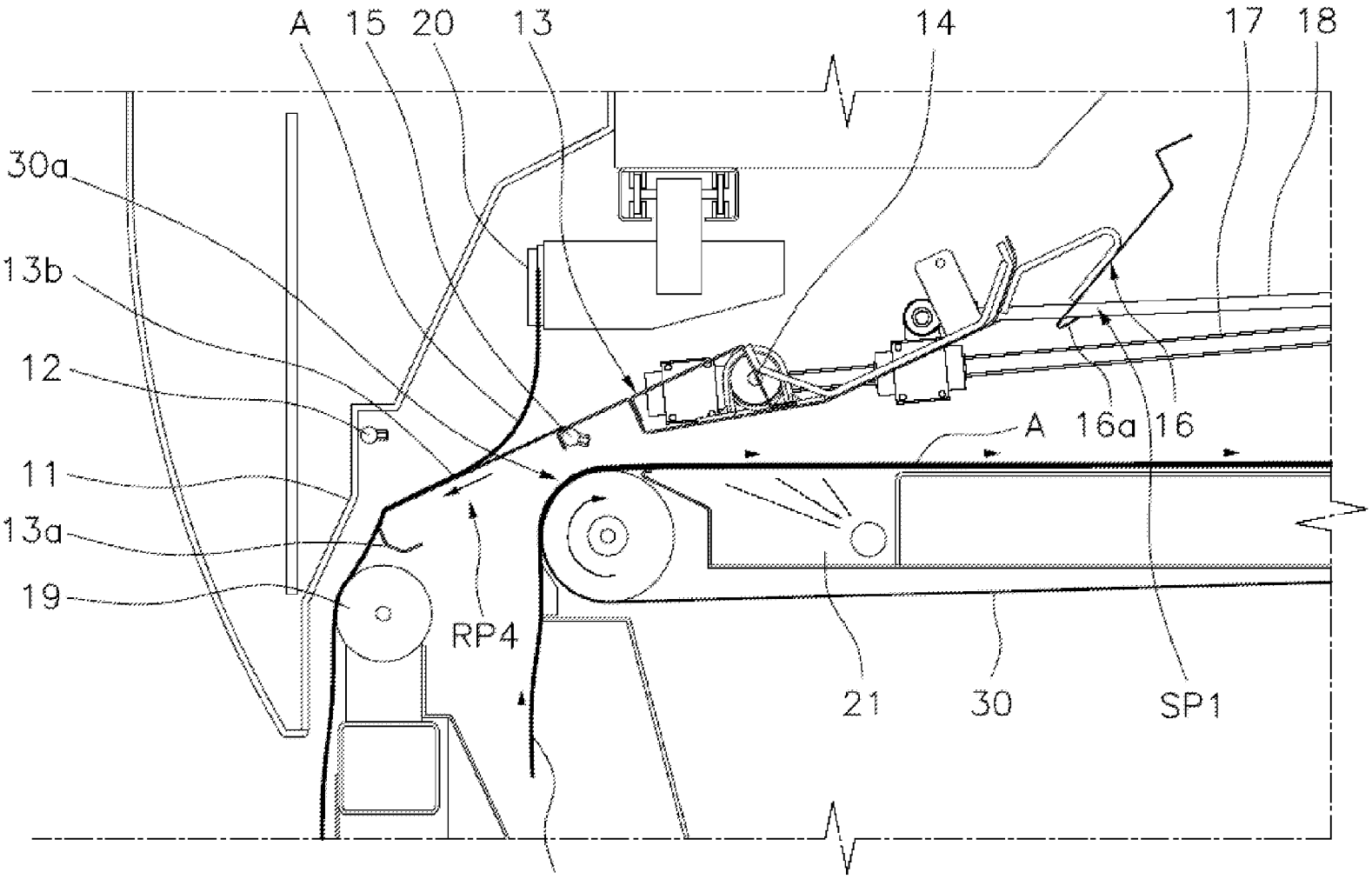
FIG. 6 is a detail schematic plan view of the auxiliary device of FIG. 1*a* in the semiautomatic loading mode in a fifth operation step, wherein the roof plate is in a second position RP2, the spoil is in a first position SP1, a flat clothing article A being conveyed by and loaded on the conveyor belt, and another flat clothing article A is gripped on an spread out by the clamps, being both flat clothing articles separated by a cover extension, extended from the roof plate.

In a fifth step, illustrated in FIG. 6, when the flat clothing article A is mostly loaded on the conveyor belt 30, the flat clothing article A lower edge has exceeded the rotating roll 19, and is pending in the wide gap, the roof plate 13 stays on the first position, and a cover 13*b* is extended covering the wide gap, so that an additional flat clothing article A gripped on the spreading clamps 20, can be placed confronted to the loading end 30*a* of the conveyor belt 30 before the complete load operation of the preceding flat clothing article A, because the additional flat clothing article A cannot interfere with the flat clothing article A which is being loaded on the conveyor belt, thanks said cover extension, on which the additional flat clothing article A lies during said fifth step.

The extension and retraction of said cover 13*b* can be achieved by a driving means, as a motor, a piston, a lineal motor, a magnetic pusher, etc.

The fifth step is followed by the first step so that the operation cycle is restarted.

It should be noted that during the second step (FIG. 3), in which the roof plate 13 is placed on the first position RP1, the previous flat clothing article A is still being transferred on the conveyor belt 30, and the spoil 16 is placed on the second position SP2, ensuring that the lower edge of the previously loaded flat clothing article A has been perfectly extended on the conveyor belt, and preventing the lifting and bending of said lower edge due the airflow blown from the nozzles 12 and the additional blowing nozzles 15. The spoil shape is designed to deflect in the second position SP2 said airflow away from said lower edge.

In an alternative embodiment spoil 16 can be driven by own driving means.

Figure 7:
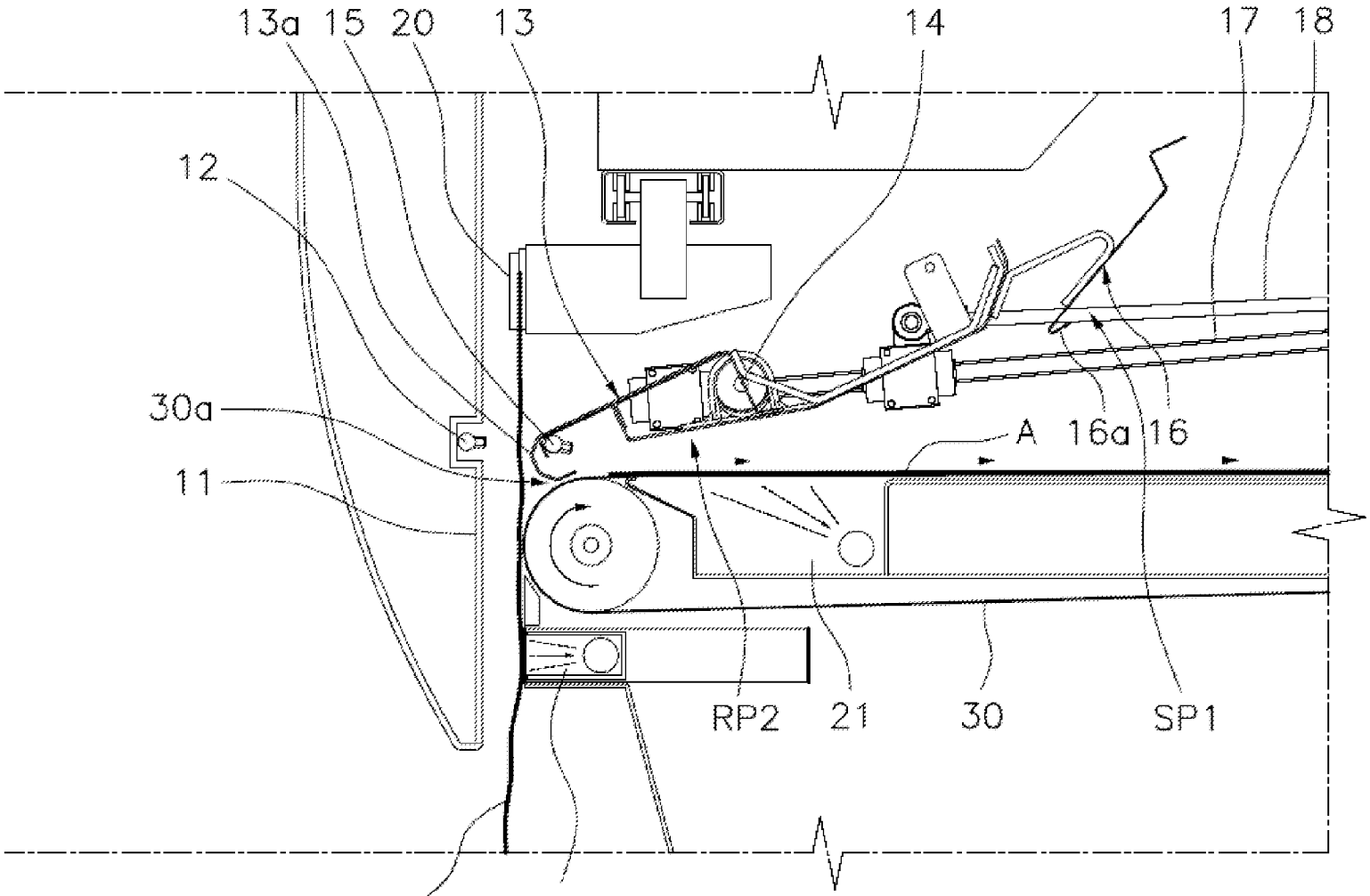
FIG. 7 is a schematic plan view of a auxiliary device for a machine for spreading out and loading flat clothing articles according to a second embodiment of the present invention with two or more loading stations in a semiautomatic loading mode, with roof plate in a second position RP2, spoil in a first position SP1, and with a flat clothing article A being gripped on and spread out by clamps in front of the conveyor belt loading end, and another flat clothing article being conveyed on the conveyor belt, said second embodiment not including any rotating roll.

In FIG. 7 a second embodiment is illustrated without rotating roll 19. In this case another suction box 40 is foreseen to attack lower section of the flat clothing article A close to the loading end 30*a*, partially supporting the weight of said flat clothing article previous to its transfer onto the conveyor belt 30.

What is claimed is:

1. A machine for spreading out and loading flat clothing articles with an auxiliary device that deposits and feeds flat clothing articles on a conveyor belt, comprising:

a frame (10) supporting one conveyor belt (30) moving in a loading direction (D), and having a loading end (30*a*);

a protective cover (11) covering said loading end (30*a*) of the conveyor belt (30) equipped with suction means;

two or more loading stations each including a pair of spreading clamps (20) moved by driving means along a guide rail transverse to said loading direction (D) between a receiving position, in which said spreading clamps (20) are adjacent to one another in one of said loading stations for catching respective contiguous corners of a flat clothing article (A) manually loaded by an operator, and a spread out position, in which the spreading clamps (20) are separated from one another holding said flat clothing article (A) by one its edges spread out and facing said loading end (30*a*) of the conveyor belt (30);

deposition means for depositing, upon clamps (20) aperture, an upper end of said flat clothing article (A) on the conveyor belt (30) from said spread out position of the spreading clamps (20), with the assistance of blowing nozzles (12); and an auxiliary device for the deposition and feeding of flat clothing articles on a conveyor belt, wherein said auxiliary device is located in superposition to the loading end (30*a*) of the conveyor belt (30), extending transverse to said loading direction (D) and comprises:

a roof plate (13) pivotally articulated around an axis (14) transverse to said loading direction (D) and providing a first position (RP1) in which the roof plate (13) is separated from the conveyor belt (30) defining a wide opening for reception of an edge of said flat clothing article (A) and a second position (RP2) in which a roof plate front end (13*a*) lies close to the loading end (30*a*) of the conveyor belt (30) allowing a controlled passage of the flat clothing article (A) extended on said conveyor belt (30), and driving means producing a rotation of said roof plate (13) between said first (RP1) and second (RP2) position in coordination with the operation of said deposition means, wherein the machine further comprises a spoil (16) articulated around an axis transverse to said loading direction (D) and defining a first position (SP1) in which a front end (16*a*) of said spoil (16) is separated from the conveyor belt and a second position (SP2) in which said front end (16*a*) of the spoil (16) lies on the surface of a flat clothing article (A) deposited on and transferred by said conveyor belt flattening said clothing article (A), and driving means producing a rotation of said spoil (16) between first and second positions in coordination with the movements of said roof plate (13).

2. The machine according to claim 1, wherein said auxiliary device further comprises additional blowing nozzles (15) attached to the underside of said roof plate (13) in an area close to said front end (13*a*) and oriented against said conveyor belt (30) in the loading direction (D).

3. The machine according to claim 2, wherein said deposition means further f includes a rotatable roll (19) on which a part of the flat clothing article (A) lies before being transferred towards the conveyor belt (30), said rotatable roll (19) being placed facing said conveyor belt loading end (30*a*) and at a distance thereof and wherein one cover (13*b*) of said roof plate (13) is movable in extension to a fourth position (RP4) in which said roof plate (13*a*) front end lies over said rotatable roll (19), providing a support for the flat clothing article (At while a previous flat clothing article (A) is moving through said loading end (30*a*) of the conveyor belt (30).

4. The machine according to claim 1, wherein said roof plate front end (13*a*) has a rounded profile providing a support that assists in the conveyance of the flat clothing article (A) towards the inside of the wide opening provided by the roof plate (13) while in said first position (P1).

5. The machine according to claim 4, wherein said deposition means further f includes a rotatable roll (19) on which a part of the flat clothing article (A) lies before being transferred towards the conveyor belt (30), said rotatable roll (19) being placed facing said conveyor belt loading end (30*a*) and at a distance thereof and wherein one cover (13*b*) of said roof plate (13) is movable in extension to a fourth position (RP4) in which said roof plate (13*a*) front end lies over said rotatable roll (19), providing a support for the flat clothing article (A), while a previous flat clothing article (A) is moving through said loading end (30*a*) of the conveyor belt (30).

6. The machine according to claim 1, wherein when the spoil (16) is in said first spoil position (SP1 t roof plate (13) is in said second position (RP2) and second spoil position (SP2) corresponds to said first roof plate position (RP1).

7. The machine according to claim 6, wherein said deposition means further f includes a rotatable roll (19) on which a part of the flat clothing article (A) lies before being transferred towards the conveyor belt (30), said rotatable roll (19) being placed facing said conveyor belt loading end (30*a*) and at a distance thereof and wherein one cover (13*b*) of said roof plate (13) is movable in extension to a fourth position (RP4) in which said roof plate (13*a*) front end lies over said rotatable roll (19), providing a support for the flat clothing article (A), while a previous flat clothing article (A) is moving through said loading end (30*a*) of the conveyor belt (30).

8. The machine according to claim 6, wherein said spoil (16) is attached to an end of said roof plate (13) remote from said front end (13*a*) and wherein said roof plate (13) and said spoil (16) are driven by said driving means.

9. The machine according to claim 8, wherein said deposition means further includes a rotatable roll (19) on which a part of the flat clothing article (A) lies before being transferred towards the conveyor belt (30), said rotatable roll (19) being placed facing said conveyor belt loading end (30*a*) and at a distance thereof and wherein one cover (13*b*) of said roof plate (13) is movable in extension to a fourth position (RP4) in which said roof plate (13*a*) front end lies over said rotatable roll (19), providing a support for the flat clothing article (A), while a previous flat clothing article (A) is moving through said loading end (30*a*) of the conveyor belt (30).

10. The machine according to claim 6, wherein said spoil (16) is driven by said driving means.

11. The machine according to claim 10, wherein said deposition means further f includes a rotatable roll (19) on which a part of the flat clothing article (A) lies before being transferred towards the conveyor belt (30), said rotatable roll (19) being placed facing said conveyor belt loading end (30*a*) and at a distance thereof and wherein one cover (13*b*) of said roof plate (13) is movable in extension to a fourth position (RP4) in which said roof plate (13*a*) front end lies over said rotatable roll (19), providing a support for the flat clothing article (A), while a previous flat clothing article (A) is moving through said loading end (30*a*) of the conveyor belt (30).

12. The machine according to claim 1, wherein said roof plate (13) is associated to guides (17) extending in the loading direction (D) allowing a third roof plate position (RP3) by sliding along said guides (17) in which the auxiliary device is withdrawn from its location in superposition to said loading end (30*a*) of the conveyor belt (30).

13. The machine according to claim 12, wherein said third roof plate position (RP3) is obtained by automatic driving means (18) or manually operated.

14. The machine according to claim 13, wherein said cover (13*b*) is displaceable by a driving means.

15. The machine according to claim 12, wherein said deposition means further f includes a rotatable roll (19) on which a part of the flat clothing article (A) lies before being transferred towards the conveyor belt (30), said rotatable roll (19) being placed facing said conveyor belt loading end (30*a*) and at a distance thereof and wherein one cover (13*b*) of said roof plate (13) is movable in extension to a fourth position (RP4) in which said roof plate (13*a*) front end lies over said rotatable roll (19), providing a support for the flat clothing article (A), while a previous flat clothing article (A) is moving through said loading end (30*a*) of the conveyor belt (30).

16. The machine according to claim 1, wherein said deposition means further includes a rotatable roll (19) on which a part of the flat clothing article (A) lies before being transferred towards the conveyor belt (30), said rotatable roll (19) being placed facing said conveyor belt loading end (30*a*) and at a distance thereof and wherein one cover (13*b*) of said roof plate (13) is movable in extension to a fourth position (RP4) in which said roof plate (13*a*) front end lies over said rotatable roll (19), providing a support for the flat clothing article (A), while a previous flat clothing article (A) is moving through said loading end (30*a*) of the conveyor belt (30).

17. The machine according to claim 1, wherein said spoil (16) is attached to an end of said roof plate (13) remote from said front end (13*a*) and wherein said roof plate (13) and said spoil (16) are driven by said driving means.

18. The machine according to claim 1, wherein said spoil (16) is driven by said driving means.

* * * * *